US008708335B2

(12) United States Patent
Akatsuka

(10) Patent No.: US 8,708,335 B2
(45) Date of Patent: Apr. 29, 2014

(54) SHEET CONVEYER DEVICE

(75) Inventor: Yasunori Akatsuka, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/432,347

(22) Filed: Mar. 28, 2012

(65) Prior Publication Data

US 2013/0001867 A1 Jan. 3, 2013

(30) Foreign Application Priority Data

Jun. 29, 2011 (JP) ..... 2011-144562

(51) Int. Cl.
*B65H 1/00* (2006.01)

(52) U.S. Cl.
USPC ..... 271/171; 399/393

(58) Field of Classification Search
USPC ..... 271/171; 399/393
See application file for complete search history.

(56) References Cited

U.S. PATENT DOCUMENTS

| | | | | |
|---|---|---|---|---|
| 7,464,927 | B2 * | 12/2008 | Ito et al. | 271/171 |
| 7,694,958 | B2 * | 4/2010 | Nakamura | 271/171 |
| 2006/0113723 | A1 | 6/2006 | Ito et al. | |
| 2012/0228820 | A1 * | 9/2012 | Otsuki | 271/147 |

FOREIGN PATENT DOCUMENTS

| | | |
|---|---|---|
| JP | 03-102015 | 4/1991 |
| JP | 2006-151656 | 6/2006 |

* cited by examiner

*Primary Examiner* — Michael McCullough
(74) *Attorney, Agent, or Firm* — Banner & Witcoff, Ltd.

(57) ABSTRACT

A sheet conveyer device including a sheet container tray and a guide member to restrict a position of edges of the sheets is provided. The sheet container tray includes a first engagement section. The guide member includes an arm part and a first engageable part being engageable with the first engagement section. One of the first engagement section and the first engageable part is formed to have a concave structure, and the other one of the first engagement section and the first engageable part is formed to have a convex structure. A first plane in the concave structure, which becomes slidably in contact with the convex structure when the guide member is moved in a pointing direction, is formed to incline in a more moderate angle than an angle of a second plane in the concave structure, which becomes separated from the convex structure.

15 Claims, 10 Drawing Sheets

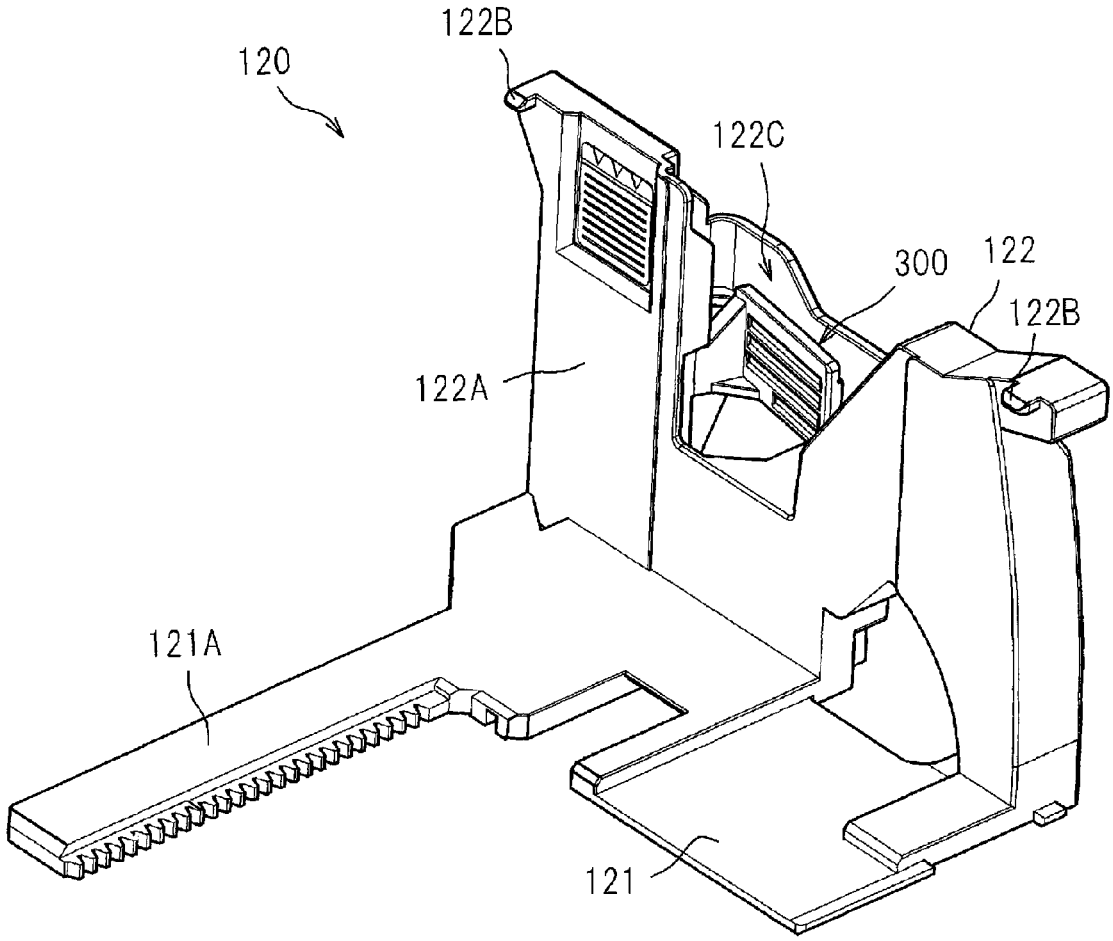
FIG. 5
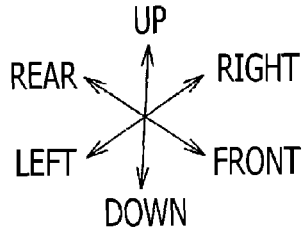

SHEET CONVEYER DEVICE

CROSS REFERENCE TO RELATED APPLICATION

This application claims priority from Japanese Patent Application No. 2011-144562, filed on Jun. 29, 2011, the entire subject matter of which is incorporated herein by reference.

BACKGROUND

1. Technical Field

An aspect of the present invention relates to a sheet conveyer device.

2. Related Art

A sheet conveyer device embedded in an image forming apparatus, to convey a sheet from a sheet container tray to an image forming unit, is known. In order to place the sheet in a correct position in the sheet container tray, the image forming apparatus may have a guide member, which is movable in a direction of sheet-length along a bottom of the sheet container tray to restrict a lengthwise position of the sheet, a plurality of size-indicative grooves, which are formed at intervals in spaced-apart positions on a rib extending along the lengthwise direction of the bottom to define predetermined standard sheet sizes, a locking grooves, which are formed in smaller intervals than the size-indicative grooves on another rib extending along the lengthwise direction, and a manipulation member, which is handled by a user to move the guide member, in the sheet container tray.

The size-indicative grooves and the locking grooves may be formed on mutually-facing inner edges of the ribs, which extend in parallel with each other along the lengthwise direction, respectively. The manipulation member may be integrally formed to have a rotation shaft, which extends vertically and is rotatably supported by the guide member, a manipulation piece, which is arranged on an upper part of the rotation shaft to be handled by the user, and two arms, which are formed to extend inward in a position between the two ribs along the lengthwise direction from a lower end portion of the rotation shaft. Each of the two arms may be formed to have a claw on a tip end thereof.

More specifically, one of the two arms closer to the rib having the size-indicative grooves may be formed to have a size-indicative claw, which is engageable with one of the size-indicative grooves. The other one of the two arms closer to the rib having the locking grooves may be formed to have a locking claw, which is engageable with one of the locking grooves. When the manipulation piece is not handled by the user, the claw may be engaged with the grooves, and the guide member movable along with the manipulation piece may be locked at a predetermined position corresponding to one of the predetermined standard size. When the manipulation piece is handled by the user, the locking claw may be disengaged from the locking grooves. Meanwhile, the size-indicative claw may be maintained fit in the size-indicative groove, but the engagement of the size-indicative claw with the size-indicative groove may be loosened. Therefore, the guide member may be released from the locking grooves to some extent and may become movable to slide in the lengthwise direction along the bottom of the sheet container tray. When the guide member is moved, whilst the size-indicative claw may trace concaves of the size-indicative grooves, the user may sense the size-indicative claw clicking and fitting in the size-indicative groove when the guide member comes in a position corresponding to one of the predetermined standard sizes.

SUMMARY

According to the known image forming apparatus, each of the size-indicative grooves may be formed in a symmetric shape with respect to a direction of sheet width. Meanwhile, intensity of force to be applied to the guide member from the size-indicative grooves may tend to vary depending on a direction for the guide member to move. More specifically, when the guide member is moved in a direction from the basal end of the arms connected with the rotation shaft toward the open ends of the arms with the claws, the size-indicative claw on the tip end of the arm may be undesirably caught in the size-indicative grooves. Therefore, it may be more difficult for the user to move the guide member in the direction from the basal end toward the open end than moving the guide member in the opposite direction. In particular, the user may feel more intense stress or uncomfortable with the clicking impression, when the guide member is moved in the direction from the basal end toward the open end, and when the size-indicative claw being caught in the size-indicative groove is forcibly moved out of the size-indicative groove.

In view of the difficulty, the present invention is advantageous in that a sheet conveyer device, in which the user may be provided with equivalent fitting impression regardless of the directions of movement of the guide member, is provided.

According to an aspect of the present invention, a sheet conveyer device is provided. The sheet conveyer device includes a sheet container tray, in which sheets can be stored, and a guide member, which is arranged to be movable on a bottom of the sheet container tray along a movable direction and is configured to restrict a position of edges of the sheets. The sheet container tray includes a first engagement section, which is provided in a plurality of positions corresponding to a plurality of sizes for the sheets. The guide member includes an arm part, which extends along the movable direction of the guide member and is configured to be rotatable about a basal end portion thereof, and a first engageable part, which is configured to be engageable with the first engagement section. One of the first engagement section and the first engageable part is formed to have a concave structure, and the other one of the first engagement section and the first engageable part is formed to have a convex structure. A first plane in the concave structure, which becomes slidably in contact with the convex structure when the guide member is moved in a pointing direction pointed by a tip end of the arm part, is formed to incline in a more moderate angle with reference to the movable direction of the guide member than an angle of a second plane in the concave structure, which becomes separated from the convex structure when the guide member is moved in the pointing direction.

According to an aspect of the present invention, an image forming apparatus is provided. The image forming apparatus includes an image forming unit, a sheet container tray, in which sheets can be stored, and a guide member, which is arranged to be movable on a bottom of the sheet container tray along a movable direction and is configured to restrict a position of edges of the sheets. The sheet container tray includes a first engagement section, which is provided in a plurality of positions corresponding to a plurality of sizes for the sheets. The guide member includes an arm part, which extends along the movable direction of the guide member and is configured to be rotatable about a basal end portion thereof, and a first engageable part, which is configured to be engageable with the first engagement section. One of the first engagement section and the first engageable part is formed to have a concave structure, and the other one of the first engagement section and the first engageable part is formed to have a convex structure. A first plane in the concave structure, which becomes slidably in contact with the convex structure when the guide member is moved in a pointing direction pointed by a tip end of the arm part, is formed to incline in a more moderate angle with reference to the movable direction of the guide member than an angle of a second plane in the concave structure, which becomes separated from the convex structure when the guide member is moved in the pointing direction.

BRIEF DESCRIPTION OF THE ACCOMPANYING DRAWINGS

FIG. 5 is a perspective view of a sheet guide in the laser printer according to the embodiment of the present invention.

DETAILED DESCRIPTION

Hereinafter, an embodiment of the present invention will be described with reference to the accompanying drawings. Before a laser printer 100 according to the present embodiment is described, however, an overall configuration of a known laser printer 1 will be described below.

Overall Configuration of a Laser Printer

Figure 1:
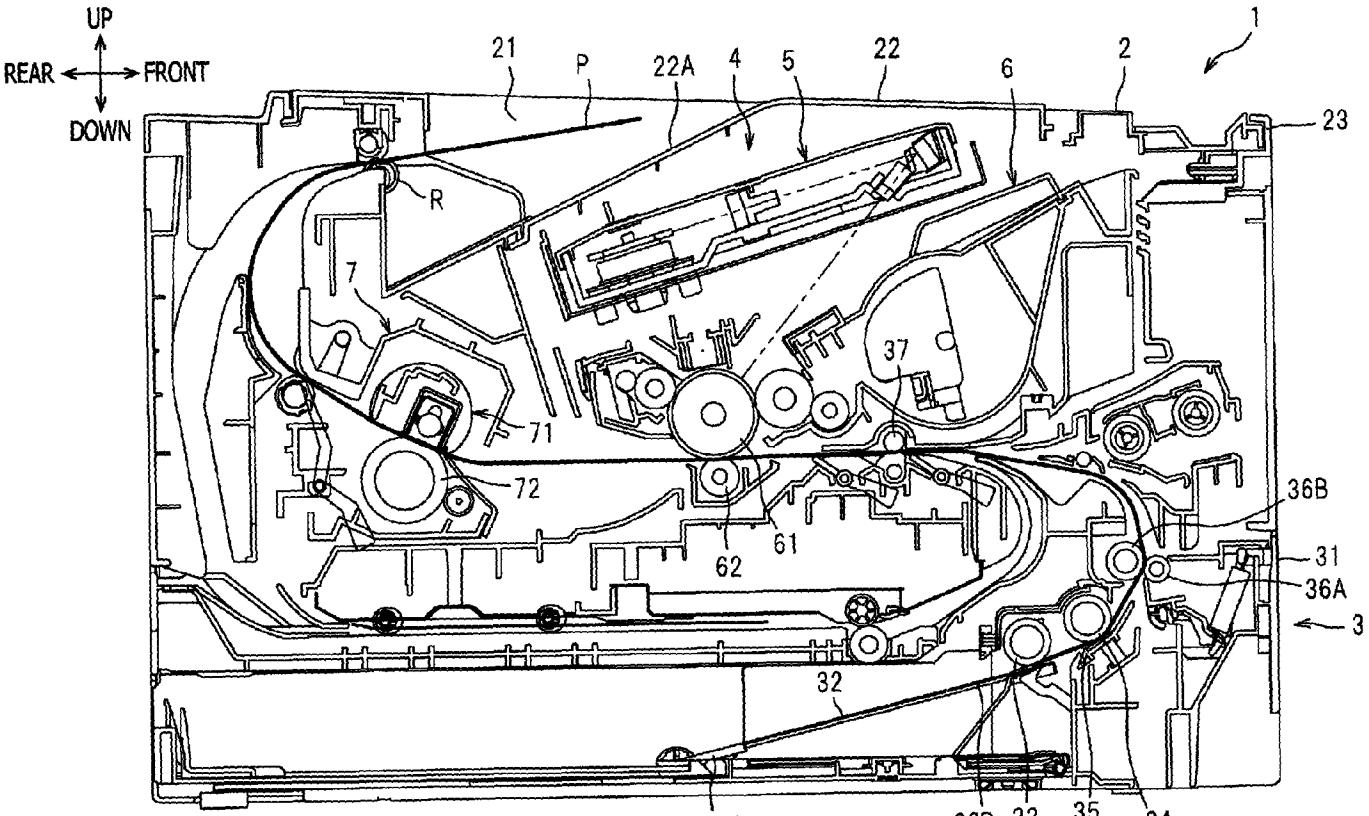
FIG. 1 is a cross-sectional side view of a known laser printer having a small-capacity sheet container tray.

An overall configuration of a known laser printer 1 will be described with reference to FIG. 1. In the description provided below, directions concerning the laser printer 1 and the laser printer 100 will be referred to based on a user's position to ordinarily use the laser printers 1, 100 and in accordance with orientation indicated by arrows in each drawings. That is, for example, a viewer's right-hand side appearing in FIG. 1 is referred to as a front side of the laser printer 1. A left-hand side in FIG. 1 opposite from the front is referred to as rear. A side, which corresponds to the viewer's nearer side is referred to as a left-side face, and an opposite side from the left, which corresponds to the viewer's further side, is referred to as a right-side face. The right-left direction of the laser printer 1 may also be referred to as a crosswise direction. The up-down direction in FIG. 1 corresponds to a vertical direction of the image forming apparatus.

The laser printer 1 includes a main housing 2, a feeder unit 3, and an image forming unit 4. The feeder unit 3 feeds a sheet P to the image forming unit 4, and the image forming unit 4 to form an image on the sheet P.

The main housing 2 includes a pair of main frames 21, which are arranged on crosswise ends of the laser printer 1, a top panel 22, which connects the main frames 21 with each other at upper portions, and a front cover 23, which is pivotable with respect to the main frames 21. The top panel 22 is formed to have a discharge tray 22A, and the sheet P with the image formed thereon is released in the discharge tray 22A.

The feeder unit 3 is arranged in a lower position in the main housing 2 and includes a sheet container tray 31, which is detachably attached to the main frames 21 through the front face, and an uplifting plate 32 arranged inside the sheet container tray 31. The feeder unit 3 further includes a pickup roller 33, a separator roller 34, and a separator pad 35. The pickup roller 33 is arranged in an upper position with respect to a front end of the sheet P stored in the sheet container tray 31. The separator roller 34 and the separator pad 35 are arranged in a downstream position with respect to the pickup roller 33 along a direction of sheet conveyance. The pickup roller 33 and the separator roller 34 are rotatably supported by a roller holder (unsigned).

The pickup roller 33 is pivotable about the separator roller 34. The uplifting plate 32 is pivotably supported by a bottom of the sheet container tray 31 to be pivotable about a rear end 32A thereof to have the front end 32B uplifted toward the pickup roller 33. The feeder unit 3 further includes a dust remover roller 36A, a conveyer roller 36B, and a pair of register rollers 37. The dust remover roller 36A is arranged in a downstream position with respect to the separator roller 34 along a sheet conveying direction. The conveyer roller 36B is arranged in a position to face the dust remover roller 36A. The register rollers 37 are arranged in downstream positions with respect to the dust remover roller 36A along the sheet conveying direction.

The sheet container tray 31 is movable along the front-rear direction with respect to the main frames 21 and is detachably attached to the main frames 21. The pickup roller 33, the separator roller 34 and the conveyer roller 36B are rotatably supported by the main housing 2. Meanwhile, the separator pad 35 and the dust remover roller 36A are rotatably supported by the sheet container tray 31. Therefore, when the sheet container tray 31 is removed out of the main housing 2, the separator pad 35 and the dust remover roller 36A are removed out of the main housing along with the sheet container tray 31, and nipping conditions between the separator roller 34 and the separator pad 35 and between the dust remover roller 36A and the conveyer roller 36B are cleared.

In the feeder unit 3 configured as above, the sheets P stored in the sheet container tray 31 are urged against the pickup roller 33 when the uplifting plate 32 pivots about the rear end 32A. Amongst the plurality of sheets P, a topmost sheet P urged against the pickup roller 33 is picked up by the pickup roller 33 as the pickup roller 33 rotates and separated from the other sheets P by the separator roller 34 and the separator pad 35. The separated sheet P is forwarded to the image forming unit 4 by the rollers 36, 37.

The image forming unit 4 includes a scanner unit 5, a processing cartridge 6, and a fixing device 7.

The scanner unit 5 is arranged in an upper position in the main housing 2 and includes a laser emitter (not shown), a polygon mirror, lenses, and reflective mirrors, which are unsigned. The scanner unit 5 emits a laser beam toward a photosensitive drum 61 to scan a circumferential surface of the photosensitive drum 61.

The processing cartridge 6 is removably installed in the main housing 2 through an opening (unsigned), which is formed in the front face of the main housing 2 and exposed when the front cover 23 is opened. The processing cartridge 6 includes the photosensitive drum 61, a transfer roller 62, and a charger, a developer roller, a toner-flattening blade, and a toner container, which are unsigned.

In the processing cartridge 6, the circumferential surface of the photosensitive drum 61 is evenly charged electrically by the charger and exposed selectively to the laser beam emitted from the scanner unit 5 whilst the photosensitive drum 61 rotates. Accordingly, an area selectively exposed to the laser beam has lower potential, and a latent image is formed in the lower potential area.

Toner contained in the toner container is supplied to the latent image formed on the circumferential surface of the photosensitive drum 61 by the developer roller, and a toner image is developed on the circumferential surface of the photosensitive drum 61. As the sheet P is carried to an intermediate position between the photosensitive drum 61 having the toner image and the transfer roller 62, the toner image is transferred onto a surface of the sheet P.

The fixing device 7 includes a heater unit 71 and a pressure roller 72. The heater unit 71 includes a halogen heater, a fixing film, and a nipping plate, which are unsigned. The pressure roller 72 nips the fixing film in cooperation with the nipping plate in the heater unit 71. When the sheet P with the transferred toner image passes by an intermediate position between the heater unit 71 and the pressure roller 72, the toner transferred onto the surface of the sheet P is thermally fixed thereon.

The sheet P with the thermally fixed image is carried by a discharge roller R, which is arranged in a downstream position with respect to the fixing device 7 along the sheet conveying direction, and is released in the discharge tray 22A.

Configuration of Laser Printer 100

Figure 2A:
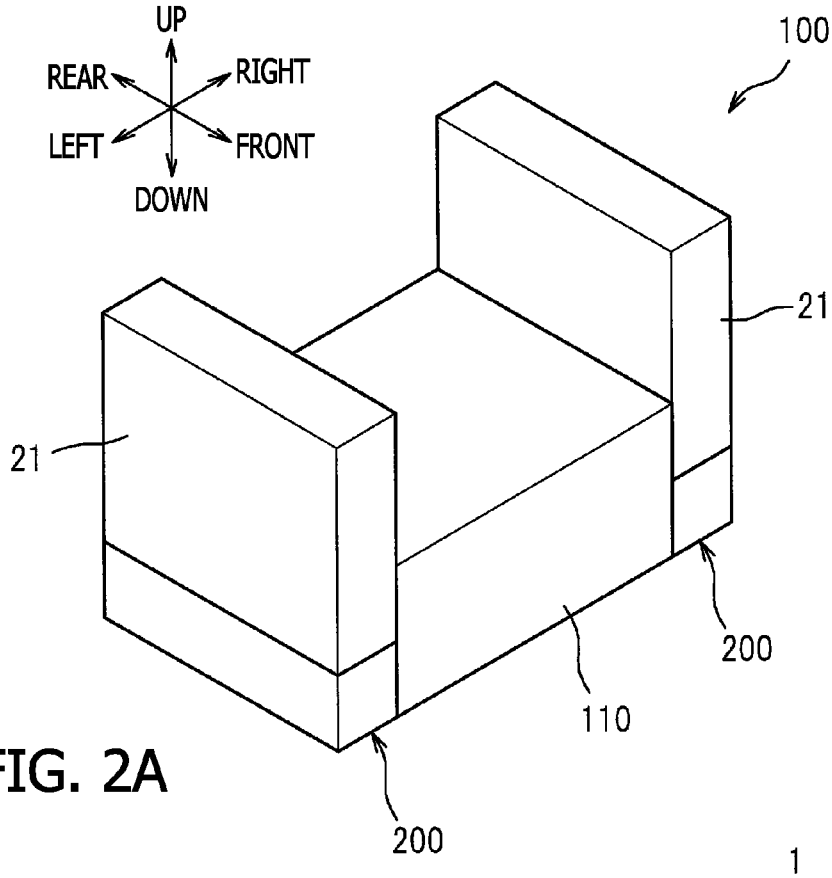
FIG. 2A is a simplified schematic view of a laser printer having a large-capacity sheet container tray according to an embodiment of the present invention.

Detailed configuration of the laser printer 100 according to the embodiment of the present invention will be described. The laser printer 100 according to the embodiment of the present invention is provided with a pair of resin-made expansion frames 200 in lower position with respect to the main frames 21 (see FIG. 2A). The laser printer 100 with the expansion frames 200 attached to the main frames 21 can hold a large-capacity sheet container tray 110, which can accommodate a larger amount of sheets P than the sheet container tray 31 of the above-described laser printer 1. In other words, in order for the laser printer 100 to accommodate a larger amount of sheets P, the large-capacity sheet container tray 110 is provided in place of the sheet container tray 31. Further, in order for the large-capacity sheet container tray 110 to be accommodated in the laser printer 100, the expansion frames 200 to provide a larger room for the large-capacity sheet container tray 110 are arranged in the lower position with respect to the main frames 21.

Thus, the laser printer 100 has the large-capacity sheet container tray 110, the pair of resin-made main frames 21, which are arranged to face each other across upper space above the large-capacity sheet container tray 110, and the pair of expansion frames 200, which are arranged to face each other across the large-capacity sheet container tray 110, when the large-capacity sheet container tray 110 is installed. The laser printer 100 also includes the other components which may be included in the laser printer 1, such as the image forming unit 4 and the top panel 22, except the sheet container tray 31; however, description of the common components may be omitted. In the following description and in FIG. 3, structures which are similar to those shown in FIG. 1 and described above with reference to the laser printer 1 will be referred to by the identical reference signs, and description of those will be omitted.

Figure 2B:
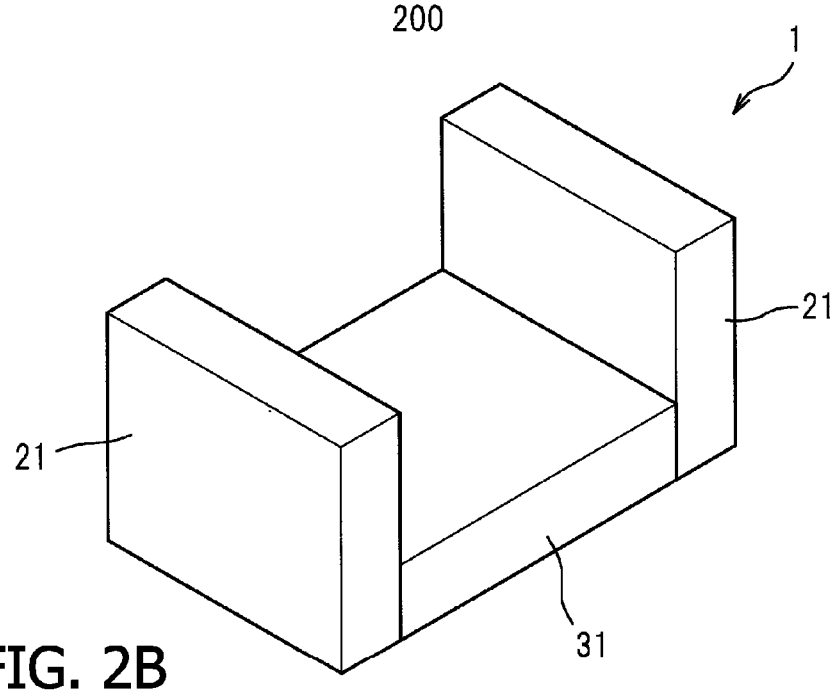
FIG. 2B is a simplified schematic view of the known laser printer having the small-capacity sheet container tray.
Figure 3:
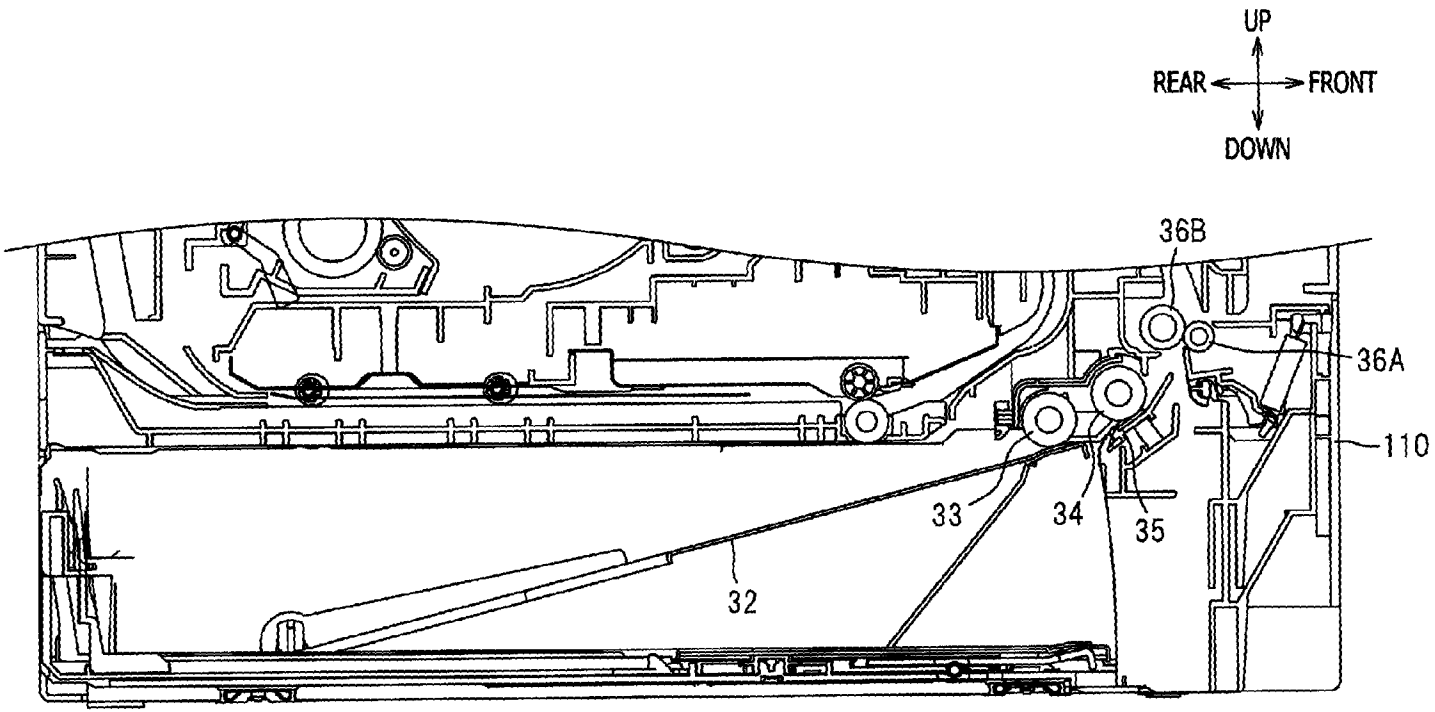
FIG. 3 is a cross-sectional partial view of a lower part of the laser printer having the large-capacity sheet container tray according to the embodiment of the present invention.

The large-capacity sheet container tray 110 is formed to have a greater height (depth) than the sheet container tray 31 (see FIG. 2B) to store the larger amount of sheets P. The large-capacity sheet container tray 110 is movable along the front-rear direction and is detachably attached to the expansion frames 200. The large-capacity sheet container tray 110 has the uplifting plate 32, the separator pad 35, and the dust remover roller 36A (see FIG. 3), which are arranged in the large-capacity sheet container tray 110 similarly to those in the sheet container tray 31. In FIGS. 1 and 3, it is to be noted that the uplifting plate 32 in an uplifted position and in a lowered position are illustrated to appear in the same drawings rather than being illustrated in separate drawings for the sake of convenience.

Figure 4:
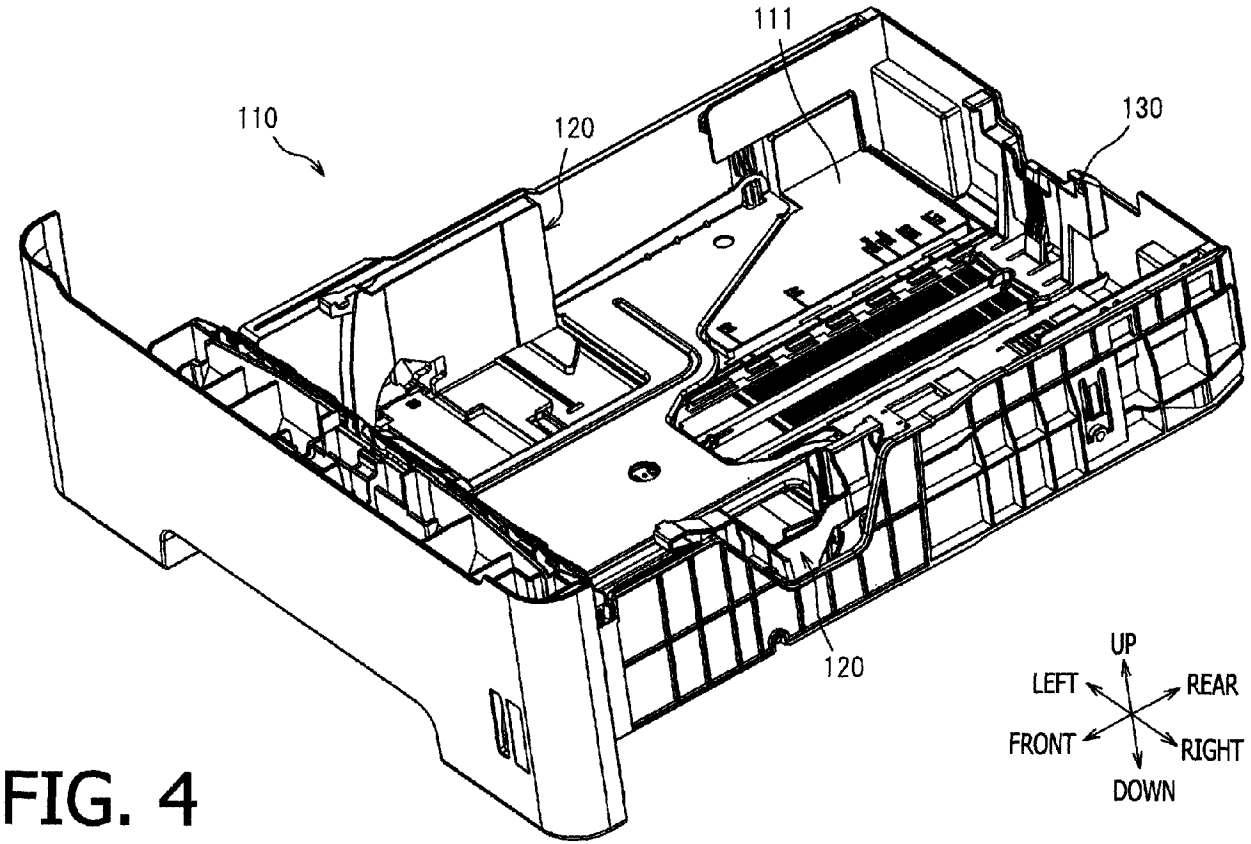
FIG. 4 is a perspective view of the large-capacity sheet container tray in the laser printer according to the embodiment of the present invention.

As shown in FIG. 4, the large-capacity sheet container tray 110 includes a pair of sheet guides 120, which restrict positions of crosswise (widthwise) edges of the sheet P, and a rear guide 130, which restricts a position of a lengthwise edge of the sheet P along the front-rear direction (i.e., the sheet conveying direction). As illustrated in the following description, the present invention can be embodied in the sheet guides 120. Additionally or alternatively, the present invention may be embodied in the rear guide 103.

The sheet guides 120 are formed to have cross-sectional shapes of "L" (see FIG. 5) and are arranged on a bottom 111 of the large-capacity sheet container tray 110 to be movable in the crosswise direction. In particular, each sheet guide 120 is formed to have a base part 121, which faces the bottom 111 when arranged in the large-capacity sheet-tray 110, and a vertical part 122, which rises upward from a crosswise outer edge of the base part 121.

The base part 121 is formed to have a rack 121A, which extends inward along the crosswise direction. The rack 121A is engaged with a gear (not shown), which is also engaged with a rack 121A formed in the other one of the sheet guides 120 arranged on the opposite side. Thereby, the pair of sheet guides 120 are movable in cooperation with each other, and when one of the sheet guides 120 is moved inward or outward along the crosswise direction, the other one of the sheet guides 120 is moved also inward or outward along the crosswise direction.

The vertical part 122 in each sheet guide 120 is formed to have a sheet-contact plane 122A and two restrictive pieces 122B. When the sheet guide 120 is placed in the position to restrict the widthwise edge of the sheet P, the sheet-contact plane 122A can be placed to be in contact with the widthwise edges of the sheet P to restrict a widthwise position of the sheet P by the contact. The restrictive pieces 122B are formed to project inward along the crosswise direction from an upper front end and an upper rear end of the vertical part 122 and can restrict a height of a stack of the sheets P. In other words, a maximum allowable amount of the sheets P can be restricted by the restrictive pieces 122B.

Further, one of the sheet guides 120 is formed to have a recessed section 122C. The recessed section 122C is open on an upper side and on an inner crosswise side closer to the sheet P. In the recessed section 122C, a manipulation member 300, which is handled by the user when the sheet guide 120 is moved, is arranged. The recessed section 122C and the manipulation member 300 may be formed and arranged solely in one of the sheet guides 120, and the other one of the sheet guides 120 may be provided with no recessed section 122C or the manipulation member 300.

Figure 6:
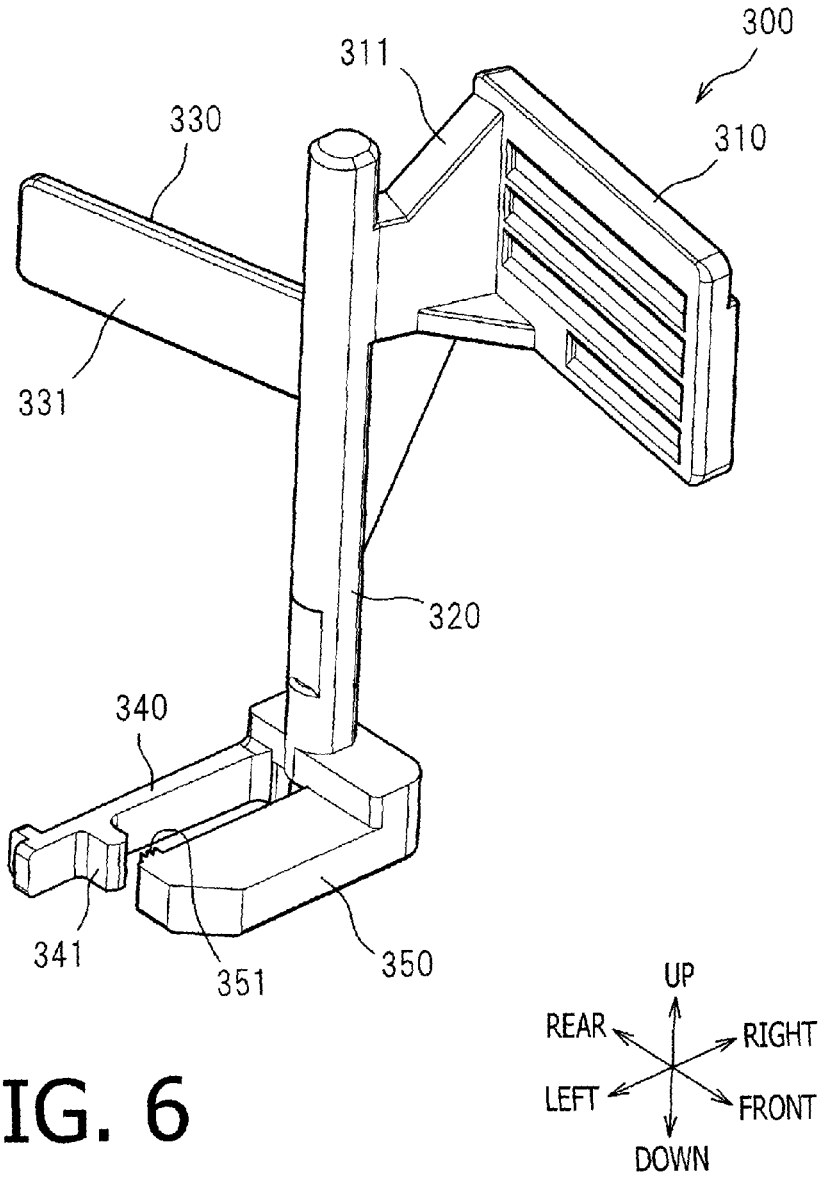
FIG. 6 is a perspective view of a manipulation member to be installed in the laser printer according to the embodiment of the present invention.

The manipulation member 300 is made of resin and is formed integrally to have a manipulation piece 310, a rotation shaft 320, an urging piece 330, a first arm 340, and a second arm 350 (see FIG. 6).

The manipulation piece 310 is a part to be handled by the user and is formed to have a shape of a rectangular plate. The manipulation piece 310 has an extended part 311, which extends from one edge of the manipulation piece 310 orthogonally with respect to a rectangular plane of the manipulation piece 310. The extended part 311 is connected to an upper end of the rotation shaft 320. In other words, the manipulation piece 310 is connected to the rotation shaft 320 via the extended part 311. Therefore, when the manipulation piece 310 is rotated by the user about the rotation shaft 320, the rotation shaft 320 rotates along with the first arm 340 and the second arm 350.

Figure 7:
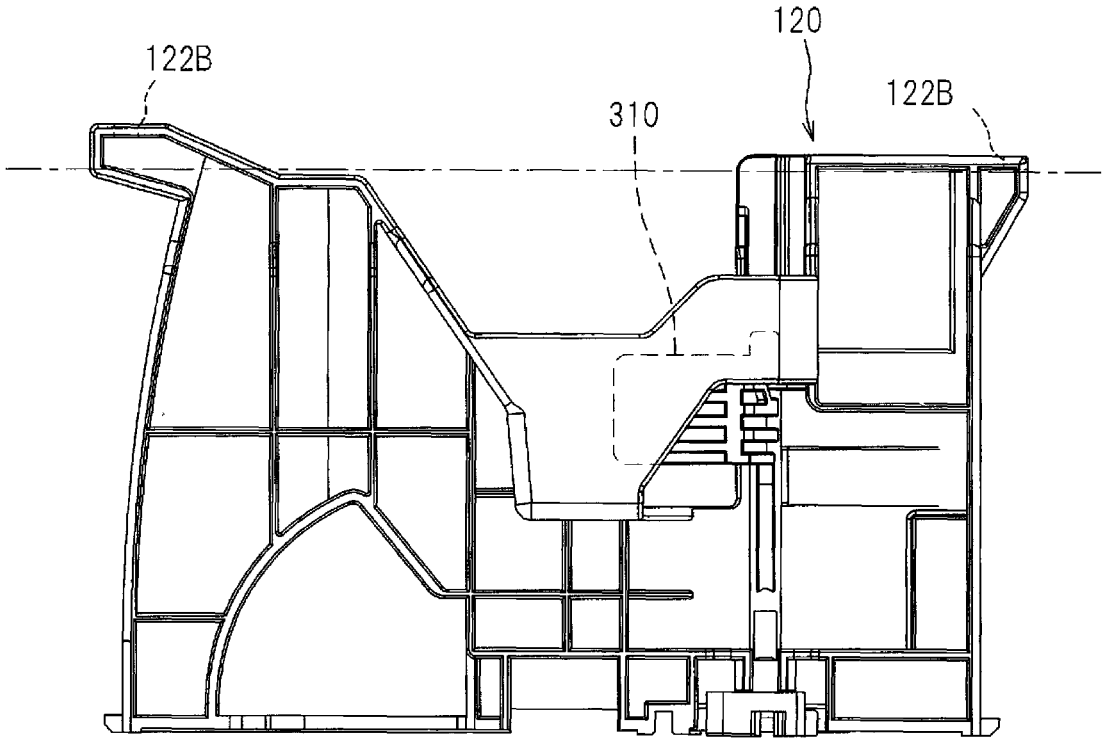
FIG. 7 is an outer side view of the sheet guide in the laser printer according to the embodiment of the present invention taken along a crosswise direction.

When the manipulation member 300 is attached to the sheet guide 120 (see FIGS. 5 and 7), the manipulation piece 310 is placed in a position lower than the restrictive pieces 122B, which are at the top edge of the sheet guide 120. More specifically, the manipulation piece 310 is placed in an approximately vertically central position within a height of the sheet guide 120. Therefore, compared to a configuration, in which the manipulation piece 310 is arranged in an upper position in a vicinity of an upper edge of the sheet guide 120, the manipulation piece 310 is arranged in the position closer to the bottom 111 of the sheet container tray 111. Accordingly, when the sheet guide 120 is moved by the user via the manipulation member 300, an amount of deformation for the sheet guide 120 to incline toward the moving direction can be reduced compared to the configuration, in which the manipulation piece is arranged at the top edge of the sheet guide 120.

In particular, in the large-capacity sheet container tray 110 according to the present embodiment, which can contain a larger amount of sheets P, the sheet guide 120 tends to have a greater height than a sheet guide 120 provided to the small-capacity sheet container tray 31. Therefore, if the manipulation piece 310 is arranged at the upper position closer to the upper edge of the sheet guide 120 with the greater height, the sheet guide 120 may tend to deform in a greater amount. Whilst deformation of the sheet guide 120 may undesirably affect mobility of the sheet guide 120, with the manipulation piece 310 arranged in the lower position, operability of the sheet guide 120 can be improved.

As the manipulation piece 310 is contained in the recessed section 122C (see FIG. 8), the manipulation piece 310 can be secured inside the recessed section 122C and can be prevented from being damaged or corrupted. Therefore, the sheet guide 120 can be prevented from becoming immovable because of the damage.

Figure 8:
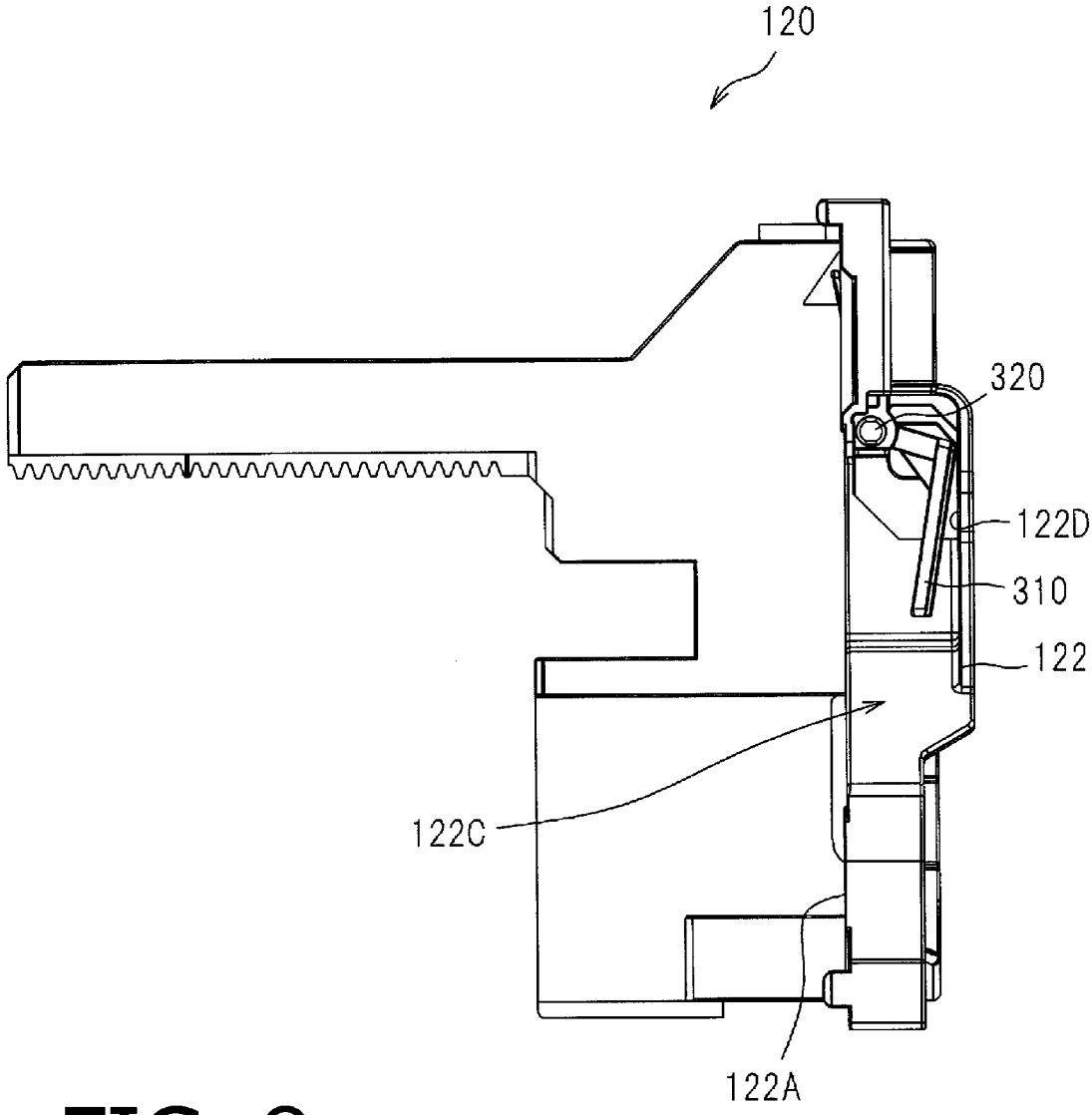
FIG. 8 is a top plane view of the sheet guide in the laser printer according to the embodiment of the present invention.

As shown in FIG. 8, the manipulation piece 310 is arranged in a skew orientation with respect to an inner plane 122D of the recessed section 122C to have an open end, which is further from the rotation shaft 320, is further apart from the inner plane 122D than a basal end, which is connected to the rotation shaft 320. Therefore, when the user pinches the manipulation piece 310 together with the vertical part 122, the manipulation piece 310 rotates about the rotation shaft 320 with respect to the sheet guide 120.

When the manipulation piece is not handled by the user, the manipulation piece 310 is in a recessed position in the recessed section 122C closer to the inner plane 122D than a plane containing the sheet-contact plane 122A. Therefore, even when the height of the stack of sheets P reaches the recessed section 122C, a room is reserved between the stacked sheets P and the manipulation member 310. Accordingly, the user is allowed to insert a finger to access the manipulation member 310 via the room to smoothly handle the manipulation member 310.

As shown in FIG. 6, the rotation shaft 320 is arranged to have an axis thereof aligned to the vertical direction and is rotatably supported by the vertical part 122 of the sheet guide 120. On the upper part of the rotation shaft 320, the manipulation piece 310 and the urging piece 330 are integrally formed, and the first arm 340 and the second arm 350 are integrally formed in the lower part.

The urging piece 330 is formed in a shape of a thin bar, which extends from the rotation shaft 320 in an approximately opposite radial direction from an extending direction of the manipulation piece 310, to serve as a blade spring. When the manipulation piece 310 is not handled, the urging piece 330 is in an initial position, in which an inner plane 331 thereof is urged against a crosswise outer surface of the vertical part 122 of the sheet guide 120 (see FIG. 5). Therefore, when the open edge of the manipulation piece 310 is pivoted outwardly about the rotation shaft 320, the urging piece 330 is rotated toward the vertical part 122, which is on the inner side with respect to the urging piece 330, against the initial urging force toward the vertical part 122. When the user releases the manipulation piece 310, the manipulation piece 310 recovers to the initial position. Further, a locking claw 351 is urged against locking grooves 114 to engage with the locking grooves 114 by the recovering force. The locking mechanism of the locking claw 351 and the locking grooves 114 will be described later in detail.

The urging piece 330 is arranged in a position to horizontally overlap the manipulation piece 310 partially. More specifically, the urging piece 330 is arranged in a partially displaced lower position with respect to the manipulation piece 310. Thereby, the rotation shaft 320 can be prevented from being distorted between the manipulation piece 310 and the urging piece 330. In other words, the urging force generated in the manipulation piece 310 is prevented from being absorbed in the rotation shaft 320. Accordingly, the first arm 340 and the second arm 350 can be pivoted at a same pivot angle as a rotation angle of the manipulation piece 310.

The first arm 340 is formed to extend rearward from the lower end of the rotation shaft 320 for a small amount and to extend inward along the crosswise direction in parallel with the movable direction of the sheet guide 120. The first arm 340 is pivotable about the rotation shaft 320 along with the rotation shaft 320. The first arm 340 is formed to have a shape of an elongated bar, which extends orthogonally with respect to the front-rear direction, and is resiliently deformable with respect to the front-rear direction. The first arm 340 is formed to have a size-indicative projection 341, which protrudes frontward in a convex structure, in a position in a vicinity of an open end of the first arm 340.

Figure 9:
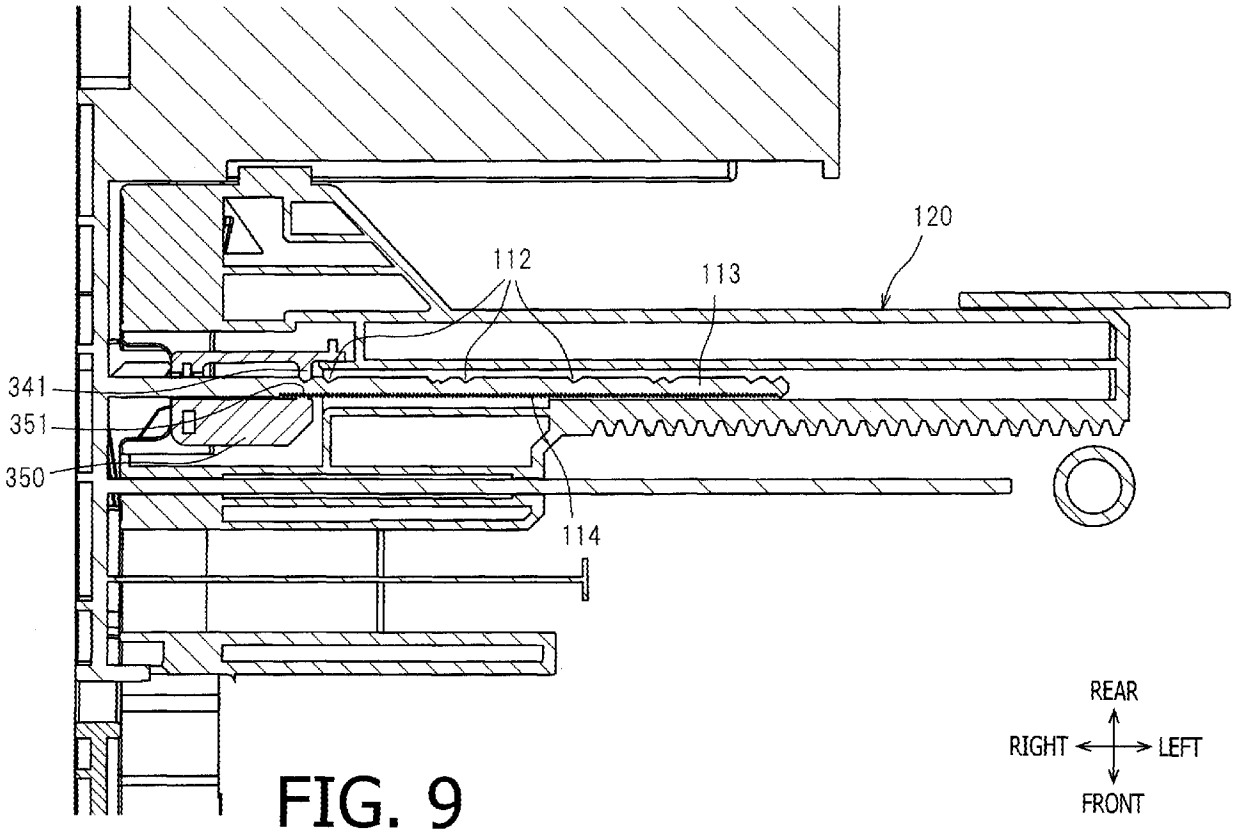
FIG. 9 is a cross-sectional horizontal view of a size-indicative projection and a locking claw in the manipulation member installed in the laser printer according to the embodiment of the present invention viewed from below.

In the large-capacity sheet container tray 110, meanwhile, a plurality of size-indicative dents 112 are formed (see FIG. 9). Each size-indicative dent 112 is formed in a concave structure and is engageable with the size-indicative projection 341. It is to be noted that FIG. 9 is a cross-sectional horizontal view of the large-capacity sheet container tray 110 viewed from the bottom; therefore, the right and left sides are inverted from those indicated in FIG. 5.

Figure 10A:
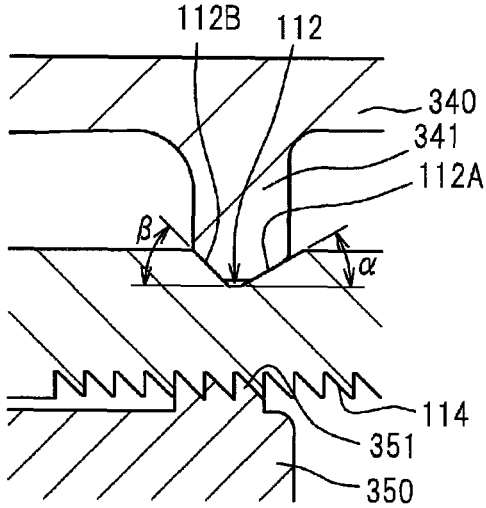
FIGS. 10A-10C are enlarged cross-sectional partial views of the size-indicative projection and the locking claw in the manipulation member installed in the laser printer according to the embodiment of the present invention.
Figure 10B:
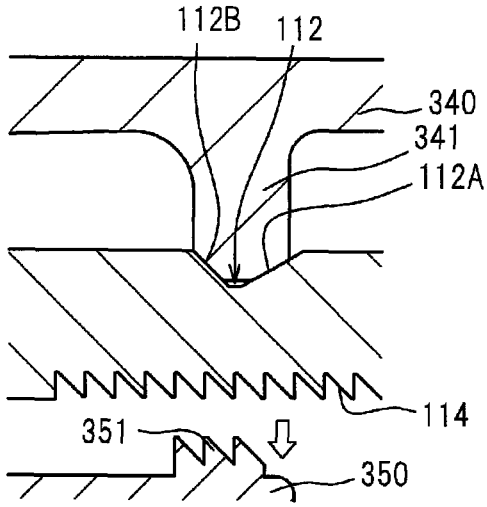
Figure 10C:
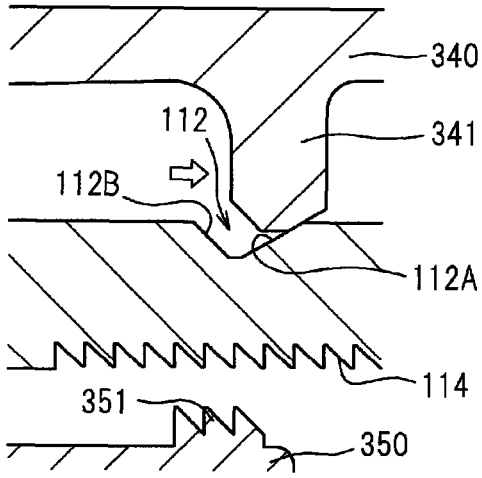

The size-indicative dents 112 are formed in positions corresponding to predetermined sizes of the sheet P on a rear plane of a rib 113, which protrudes upward from the bottom 111 of the large-capacity sheet container tray 110 and extends along the crosswise direction. As shown in FIG. 10A, each size-indicative dent 112 is formed to have a first plane 112A, which is formed in an inner position closer to an open end of the rib 113 along the crosswise direction, and a second plane 112B, which is formed in an outer position further from the open end of the rib 113 along the crosswise direction. The first plane 112A is also closer to the open end of the first arm 340 and the second plane 112B is further from the open end of the first arm 340 when the size-indicative projection 341 is engaged with the size-indicative dent 112. The first plane 112A is slidably in contact with the size-indicative projection 341 (see FIG. 10C) when the size-indicative projection 341 engaged with one of the size-indicative dents 112 is moved crosswise in a pointing direction, which is pointed by the open end of the first arm 340. At the same time, the second plane 112B is separated from the size-indicative projection 341.

The first plane 112A is formed to incline in a more moderate angle with reference to the crosswise direction than the second plane 112B. More specifically, an angle $\alpha$ of the first plane 112A with reference to the crosswise direction (i.e., the movable direction of the sheet guide 120) is smaller than an angle $\beta$ of the second plane 112B with reference to the crosswise direction (see FIG. 10A). Therefore, when the sheet guide 120 is moved in the pointing direction of the first arm 340, the size-indicative projection 341 can be moved out of the size-indicative dent 112 smoothly, and the open end portion of the first arm 340 including the size-indicative projection 341 can be prevented from being caught in the size-indicative dents 112. Thus, when the sheet guide 120 is moved in the pointing direction, the user may sense similar clicking reaction to the clicking reaction, which can be sensed when the sheet guide 120 is moved in the direction toward the basal end.

In the present embodiment, the size-indicative projection 341 is formed in the shape to at least partially fit the size-indicative dents 112. However, the size-indicative projection 341 may not necessarily be formed in the shape to fit the size-indicative dents 112 as described above. For example, the size-indicative projection 341 may be formed to have a round open end. Further, whilst the clicking impression from the size-indicative projection 341 may vary depending on the shapes and material of the first arm 340, the angle $\alpha$ of the first plane 112A and the angle $\beta$ of the second plane 112B may be adjusted based on experiments and simulations in order to provide similar clicking impression.

In the manipulating member 300, meanwhile, the second arm 350 is formed to extend frontward from the lower end of the rotation shaft 320 for a small amount and to extend inward along the crosswise direction in parallel with the movable direction of the sheet guide 120 (see FIG. 6). Therefore, the second arm 350 is in a position to face the first arm 340 along the front-rear direction and is pivotable about the rotation shaft 320 at the basal end along with the first arm 340 and the rotation shaft 320. The second arm 350 is formed to have a locking claw 351, which extends rearward from an open end of the second arm 350. The locking claw 351 is formed to provide a concave structure and faces the size-indicative projection 341 of the first arm 340 within the front-rear direction. In other words, the locking claw 351 and the size-indicative projection 341 are arranged to have the rib 113 (see FIG. 9) in an intermediate position there-between within the front-rear direction.

Meanwhile, in the large-capacity sheet container tray 110, a plurality of locking grooves 114 being a concave structure are formed (see FIGS. 9 and 10A). The locking grooves 114 are formed at smaller intervals than the intervals between the size-indicative dents 112.

The locking claw 351 is formed to be engaged with a part of the locking grooves 114 by the initial urging force from the urging piece 330 when the user does not handle the manipulation piece 310. When the user handles the manipulation piece 310 against the initial urging force from the urging piece 330, the locking claw 351 is separated from the locking grooves 114 (see FIG. 10B). Therefore, the user can move the sheet guide 120 and achieve the clicking reaction from the size-indicative projection 341 tracing the size-indicative dents 112 via the manipulation piece 310 whilst the locking claw 351 is maintained disengaged from the locking grooves 114. When the sheet guide 120 is in a position corresponding to one of the predetermined standard sizes, the user can feel the size-indicative projection 341 fitting in one of the size-indicative dents 112 via the manipulation piece 310. Therefore, the user can release the manipulation piece 310. Accordingly, the locking claw 351 is engaged with a part of the locking grooves 114 by the initial urging force from the urging piece 330, and the sheet guide 120 can be securely locked at the correct position corresponding to one of the predetermined standard sizes.

A method to manipulate the sheet guide 120 will be described hereinbelow. In order to move the sheet guide 120 to a position corresponding to a desired sheet size, the user pinches the manipulation piece 310 of the manipulation member 300 along with the vertical part 122 of the sheet guide 120 by fingers against the initial urging force in the manipulation member 300. Thereby, the manipulation member 300 is rotated about the rotation shaft 320, and the locking claw 351 is disengaged from the locking grooves 114 (see FIG. 10B). In this regard, the open end of the first arm 340 is urged against the rib 113; therefore, the first arm 340 deforms, and the size-indicative groove 341 is urged against the size-indicative dent 112.

Thereafter, the user slidably moves the sheet guide 120 along the crosswise direction to a desired position. The sheet guide 120 is moved with the size-indicative projection 341 slidably tracing the rear edge of the rib 113. In this regard, each time the size-indicative projection 341 is engaged with the size-indicative dent 112, i.e., each time the size-indicative projection 341 fits in and moves out of the size-indicative dent 112, the user can be provided with the clicking impression via the manipulation piece 310.

In this regard, with the size-indicative dent 112 having the first plane 112B and the second plane 112B, which are formed in different angles with respect to the crosswise direction, the clicking impressions can be equalized between the sheet guide 120 being moved in the pointing direction of the first arm 340 and the sheet guide 120 being moved toward the basal end of the first arm 340. Therefore, the user may be prevented from sensing different clicking impression depending on the direction to move the sheet guide 120. When the user senses the size-indicative projection 341 being engaged with the size-indicative dent 112 in the desired position, the user may release the manipulation piece 310 and the vertical section 112. Accordingly, the locking claw 351 is engaged with a part of the locking grooves 114 by the initial urging force from the urging piece 330, and the sheet guide 120 is locked thereat.

Although an example of carrying out the invention has been described, those skilled in the art will appreciate that there are numerous variations and permutations of the sheet conveyer device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the convex-and-concave structure of the size-indicative projection 341 and the size-indicative dents 112 may be inverted. In other words, the first arm 340 may have a size-indicative dent whilst the rib 113 may be formed to have size-indicative projections. Similarly, the second arm 350 may have locking grooves whilst the rib 113 may be formed to have locking claws. When the arms have the concave structure and the large-capacity sheet container tray 110 has the convex structure, the planes formed in the concave structure closer to the basal end of the arm become planes to be in slidable contact with the convex structure, when the sheet guide 120 is moved in the pointing direction of the arms and when the engaged convex and concave structure is disengaged. In other words, the planes in the concave structure closer to the open end of the arms become the planes to be separated from the convex structure. Therefore, the planes closer to the basal end are formed to incline in a smaller angle with respect to the crosswise direction than an angle of the planes closer to the open end. The planes in the concave structure may not necessarily be flat planes but may be curved.

For another example, the locking claw 351 in the manipulation member 300 and the locking grooves 114 in the rib 113 may be omitted whilst the size-indicative projection 341 and the size-indicative dents 112 are maintained.

For another example, the first arm 340 having the size-indicative projection 341 may not necessarily be formed in the manipulation member 300 but may be integrally formed with the sheet guide 120.

For another example, the manipulation member 300 may not necessarily be rotatable but may be slidable with respect to the sheet guide 120.

For another example, the sheet P being a recording medium may not necessarily be regular printer-dedicated paper, but may be, for example, cardboard, thinner paper, or an OHP film.

For another example, the sheet conveyer may not necessarily be embodied in the image forming apparatus but may be embodied in other sheet conveyable devices. Further, the image forming apparatus may not necessarily be the laser printer 100 but may be the image forming apparatus 1 with the small-capacity sheet container tray 31. Further, the image forming apparatus may be a copier or a multifunction peripheral machine.

What is claimed is:

1. An apparatus, comprising:

a sheet container tray, in which sheets can be stored; and a guide member, which is arranged to be movable on a bottom of the sheet container tray along a movable direction and is configured to restrict a position of edges of the sheets, wherein the sheet container tray includes a plurality of first engagement sections, which is provided in a plurality of positions corresponding to a plurality of sizes for the sheets;

wherein the guide member includes an arm part, which extends longitudinally along the movable direction of the guide member at the bottom of the sheet container tray and is configured to be rotatable in a plane parallel to the bottom of the sheet container tray about a basal end portion of the arm part, and a first engageable part, which is configured to be engageable with the first engagement sections;

wherein one of the plurality of first engagement sections and the first engageable part is formed to have a concave structure, and the other one of the plurality of first engagement sections and the first engageable part is formed to have a convex structure;

wherein a first plane in the concave structure, which becomes slidably in contact with the convex structure when the guide member is moved in a pointing direction pointed by a longitudinal tip end of the arm part at the bottom of the sheet container tray, is formed to incline in a more moderate angle with reference to the movable direction of the guide member than an angle of a second plane in the concave structure, which becomes separated from the convex structure when the guide member is moved in the pointing direction;

wherein the sheet container tray includes a plurality of second engagement sections, which is provided in a plurality of positions at smaller intervals than intervals between the first engagement sections;

wherein the guide member includes a manipulation member;

wherein the manipulation member includes the arm part, the first engageable part, a manipulation part to be manipulated by a user, a second engageable part configured to be engageable with the second engagement sections, and an urging part configured to urge the second engageable part against the second engagement sections; and wherein the second engageable part is separated from the second engagement sections when the manipulation part is manipulated against urging force from the urging part.

2. The apparatus according to claim 1, wherein the guide member is provided with a restrictive section, which is configured to restrict a maximum allowable amount of the sheets to be stored in the sheet container tray; and wherein the manipulation part is arranged in a position lower than the restrictive section.

3. The apparatus according to claim 2, wherein the guide member is formed to have a recessed section, which is open on an upper side and on a side adjacent to the edges of the sheets stored in the sheet container tray; and wherein the manipulation member is accommodated in the recessed section.

4. The apparatus according to claim 1, wherein the manipulation member is rotatably supported by a rotation shaft, which is integrally formed with the manipulation part, the arm part, the second engageable part, and the urging part; and wherein the rotation shaft is arranged to have an axis thereof aligned with a vertical direction.

5. The apparatus according to claim 4, wherein the manipulation part and the urging part are arranged at positions such that they have a horizontal plane in common.

6. An image forming apparatus, comprising:

an image forming unit;

a sheet container tray, in which sheets can be stored; and a guide member, which is arranged to be movable on a bottom of the sheet container tray along a movable direction and is configured to restrict a position of edges of the sheets, wherein the sheet container tray includes a plurality of first engagement sections, which is provided in a plurality of positions corresponding to a plurality of sizes for the sheets;

wherein the guide member includes an arm part, which extends longitudinally along the movable direction of the guide member at the bottom of the sheet container tray and is configured to be rotatable in a plane parallel to the bottom of the sheet container tray about a basal end portion of the arm part, and a first engageable part, which is configured to be engageable with the first engagement sections;

wherein one of the plurality of first engagement sections and the first engageable part is formed to have a concave structure, and the other one of the plurality of first engagement sections and the first engageable part is formed to have a convex structure;

wherein a first plane in the concave structure, which becomes slidably in contact with the convex structure when the guide member is moved in a pointing direction pointed by a longitudinal tip end of the arm part at the bottom of the sheet container tray, is formed to incline in a more moderate angle with reference to the movable direction of the guide member than an angle of a second plane in the concave structure, which becomes separated from the convex structure when the guide member is moved in the pointing direction;

wherein the sheet container tray includes a plurality of second engagement sections, which is provided in a plurality of positions at smaller intervals than intervals between the first engagement sections;

wherein the guide member includes a manipulation member;

wherein the manipulation member includes the arm part, the first engageable part, a manipulation part to be manipulated by a user, a second engageable part configured to be engageable with the second engagement sections, and an urging part configured to urge the second engageable part against the second engagement sections; and wherein the second engageable part is separated from the second engagement sections when the manipulation part is manipulated against urging force from the urging part.

7. An apparatus, comprising:

a sheet container tray configured to store sheets, and comprising a rib that extends from a side of the sheet container tray and has at least one first engagement section; and a guide member configured to move back and forth along the rib and maintain slidable contact with the rib, the guide member comprising:

an arm part configured to rotate about a shaft at a basal end of the arm part; and a first engageable part configured to engage the at least one first engagement section, wherein one of the at least one first engagement section and the first engageable part includes a concave structure, and the other one of the at least one first engagement section and the first engageable part includes a convex structure, wherein the concave structure comprises a first wall and a second wall having different slopes, wherein the first wall of the concave structure, which slidably contacts the convex structure when the guide member moves in a first moving direction away from the side of the sheet container tray and when the convex structure slides out of the concave structure, is sloped at a first angle with respect to the first moving direction of the guide member, wherein the second wall of the concave structure, which slidably contacts the convex structure when the guide member moves in a second moving direction towards the side of the sheet container tray and when the convex structure slides out of the concave structure, is sloped at a second angle with respect to the second moving direction of the guide member, wherein the first angle is smaller than the second angle, wherein the rib has at least one second engagement section, wherein the guide member comprises:

a second engageable part configured to engage the at least one second engagement section;

a manipulation member configured to be operated to release the second engageable part from an engagement with the at least one second engagement section, a base part, which is arranged in a first plane that is parallel to a bottom surface of the sheet container tray;

an upright part, which rises from an edge of the base part and is arranged in a second plane that is parallel to the side of the sheet container tray; and the shaft, which extends along the upright part in an orthogonal direction with respect to the arm part and the base part, and wherein the manipulation member is connected to an upper part of the shaft.

8. The apparatus of claim 7, wherein the arm part is configured to extend in a direction approximately parallel to the rib, and to flex as the first engageable part and the at least one first engagement section engage and disengage.

9. The apparatus of claim 7, wherein the at least one first engageable section is arranged on a first surface of the rib, and the second engageable section is arranged on a second surface of the rib different from the first surface.

10. The apparatus of claim 7, wherein the guide member comprises a second arm part configured to rotate about the shaft, wherein the second arm part extends in parallel to the arm part, and wherein, when the second engageable part is engaged with the at least one second engagement section, the first engageable part is engaged with the at least one first engagement section, and when the second engageable part is disengaged from the at least one second engagement section, the first engageable part is urged toward the at least one first engagement section by an urging member.

11. The apparatus of claim 7, further comprising:

an urging member that is arranged to extend from the shaft in a radial direction and is configured to urge the second engageable part, when the manipulation member is moved in a direction to release the second engageable part from engagement with the at least one second engagement section, in a direction opposite from a releasing direction of the manipulation member.

12. The apparatus of claim 11, wherein the manipulation member and the urging member are arranged in neighboring positions with respect to each other at the upper part of the shaft.

13. The apparatus of claim 7, wherein the upright part of the guide member comprises a restrictive section configured to set a height of a stack of sheets allowable to be stacked in the sheet container tray; and wherein the manipulation member is arranged in a position lower than the restrictive section.

14. The apparatus of claim 13, wherein the upright part of the guide member is formed to have a recessed section, which is open on an upper side and on a side facing a sheet stackable area of the sheet container tray; and wherein the manipulation member is accommodated in the recessed section.

15. The apparatus of claim 14, wherein the sheet container tray is configured to fit with a feeder such that the feeder is in a position to pick up a sheet from the sheet container tray and convey the sheet along a conveying direction.

* * * * *